US010124937B2

(12) United States Patent
Wiesman

(10) Patent No.: US 10,124,937 B2
(45) Date of Patent: Nov. 13, 2018

(54) LID ASSEMBLY FOR DRINKING CUP WITH INTEGRAL HINGE MOUNT FOR CAP

(71) Applicant: Helen of Troy Limited, Belleville, St. Michael (BB)

(72) Inventor: Joshua P. Wiesman, Weston, MA (US)

(73) Assignee: Helen of Troy Limited, St. Michael (BB)

( * ) Notice: Subject to any disclaimer, the term of this patent is extended or adjusted under 35 U.S.C. 154(b) by 371 days.

(21) Appl. No.: 14/844,548

(22) Filed: Sep. 3, 2015

(65) Prior Publication Data

US 2017/0066569 A1 Mar. 9, 2017

(51) Int. Cl.

| | |
|---|---|
| ***B65D 47/14*** | (2006.01) |
| ***A47G 19/22*** | (2006.01) |
| ***B65D 43/02*** | (2006.01) |
| ***B65D 47/32*** | (2006.01) |
| ***B65D 51/18*** | (2006.01) |
| ***B65D 47/08*** | (2006.01) |

(52) U.S. Cl.

CPC ..... *B65D 47/14* (2013.01); *A47G 19/2272* (2013.01); *B65D 43/02* (2013.01); *B65D 47/0885* (2013.01); *B65D 47/32* (2013.01); *B65D 51/18* (2013.01); *B65D 2251/009* (2013.01); *B65D 2251/0025* (2013.01); *B65D 2251/0028* (2013.01); *B65D 2251/0081* (2013.01); *B65D 2543/00046* (2013.01)

(58) Field of Classification Search

CPC ..... A47G 19/2272; B65D 43/02; B65D 47/0885; B65D 47/14; B65D 47/32; B65D 51/18; B65D 2251/0025; B65D 2251/0028; B65D 2251/0081; B65D 2251/009; B65D 2543/00046; B65D 47/06; B65D 47/147

USPC ..... 220/703, 705, 707, 709, 711, 714, 717

See application file for complete search history.

(56) References Cited

U.S. PATENT DOCUMENTS

| | | | |
|---|---|---|---|
| 3,747,791 | A | 7/1973 | Fouser |
| 5,762,216 | A | 6/1998 | Takeuchi |
| 5,908,126 | A | 6/1999 | Wang |
| 5,944,234 | A | 8/1999 | Lampe |
| 6,375,028 | B1 | 4/2002 | Smith |
| 6,409,034 | B2 | 6/2002 | Schorner |
| 6,951,292 | B2 | 10/2005 | Bando et al. |

(Continued)

FOREIGN PATENT DOCUMENTS

| | | |
|---|---|---|
| WO | 2014/100168 | 6/2014 |

OTHER PUBLICATIONS

International Search Report filed in PCT/US2016/047466 dated Nov. 15, 2016.

*Primary Examiner* — James N Smalley
*Assistant Examiner* — Madison L Poos
(74) *Attorney, Agent, or Firm* — Rankin, Hill & Clark LLP

(57) ABSTRACT

A lid assembly for connecting with an associated drinking cup includes a cover and a cap. The cover is configured to attach with the associated drinking cup for covering an open top of the associated drinking cup. The cover is formed of a soft, flexible material and includes an integrally molded spout and an integrally molded cap mount. The cap is configured to connect with the cap mount for pivotal movement with respect to the cover about a pivot axis. With the cap connected to the cap mount, the cap is moveable between an open position where the spout is accessible to be received inside a person's mouth and a closed position where the cap covers the spout.

21 Claims, 4 Drawing Sheets

(56) References Cited

U.S. PATENT DOCUMENTS

| | | | | |
|---|---|---|---|---|
| 7,059,490 | B2 | 6/2006 | Son | |
| 8,528,761 | B2 | 9/2013 | Yarro et al. | |
| 8,777,028 | B2 | 7/2014 | Sakulsacha | |
| 9,221,585 | B1 * | 12/2015 | Wang | B65D 41/02 |
| 2002/0036207 | A1 | 3/2002 | Ohuo | |
| 2003/0132185 | A1 | 7/2003 | Beaudette | |
| 2006/0249473 | A1 | 11/2006 | Kunz | |
| 2009/0045206 | A1 | 2/2009 | Walker | |
| 2011/0220674 | A1 * | 9/2011 | Honeyghan | A47G 19/22 220/849 |
| 2012/0312832 | A1 | 12/2012 | Lane | |
| 2014/0069946 | A1 | 3/2014 | Gubitosi et al. | |
| 2014/0217128 | A1 | 8/2014 | Samartgis | |
| 2014/0252017 | A1 * | 9/2014 | Yamada | B65D 47/0814 220/810 |
| 2014/0291275 | A1 | 10/2014 | Licari | |
| 2015/0238030 | A1 | 8/2015 | Brown | |
| 2015/0314929 | A1 * | 11/2015 | Tebbe | B65D 47/06 222/567 |

* cited by examiner

LID ASSEMBLY FOR DRINKING CUP WITH INTEGRAL HINGE MOUNT FOR CAP

BACKGROUND

Children's drinking cups can be provided with removable lids to help prevent spills. These lids often include upwardly extending spouts. Children place the spouts in their mouth to sip from the cups.

Since children place the spouts in their mouth, it is desirable to keep the spout clean. Caps have been provided for such spouts. In known drinking cups having a spout and an associated cap, it is necessary to appropriately align the lid having the spout with the cap for the spout. This can make assembly of the lid complex.

SUMMARY

In view of the foregoing, a lid assembly for connecting with an associated drinking cup includes a cover and a cap. The cover is configured to attach with the associated drinking cup for at least partially covering an open top of the associated drinking cup. The cover is formed of a soft, flexible material and includes an integrally molded spout and an integrally molded cap mount. The cap is configured to connect with the cap mount for pivotal movement with respect to the cover about a pivot axis. With the cap connected to the cap mount, the cap is moveable between an open position where the spout is accessible to be received inside a person's mouth and a closed position where the cap covers the spout.

DETAILED DESCRIPTION

Figure 1:
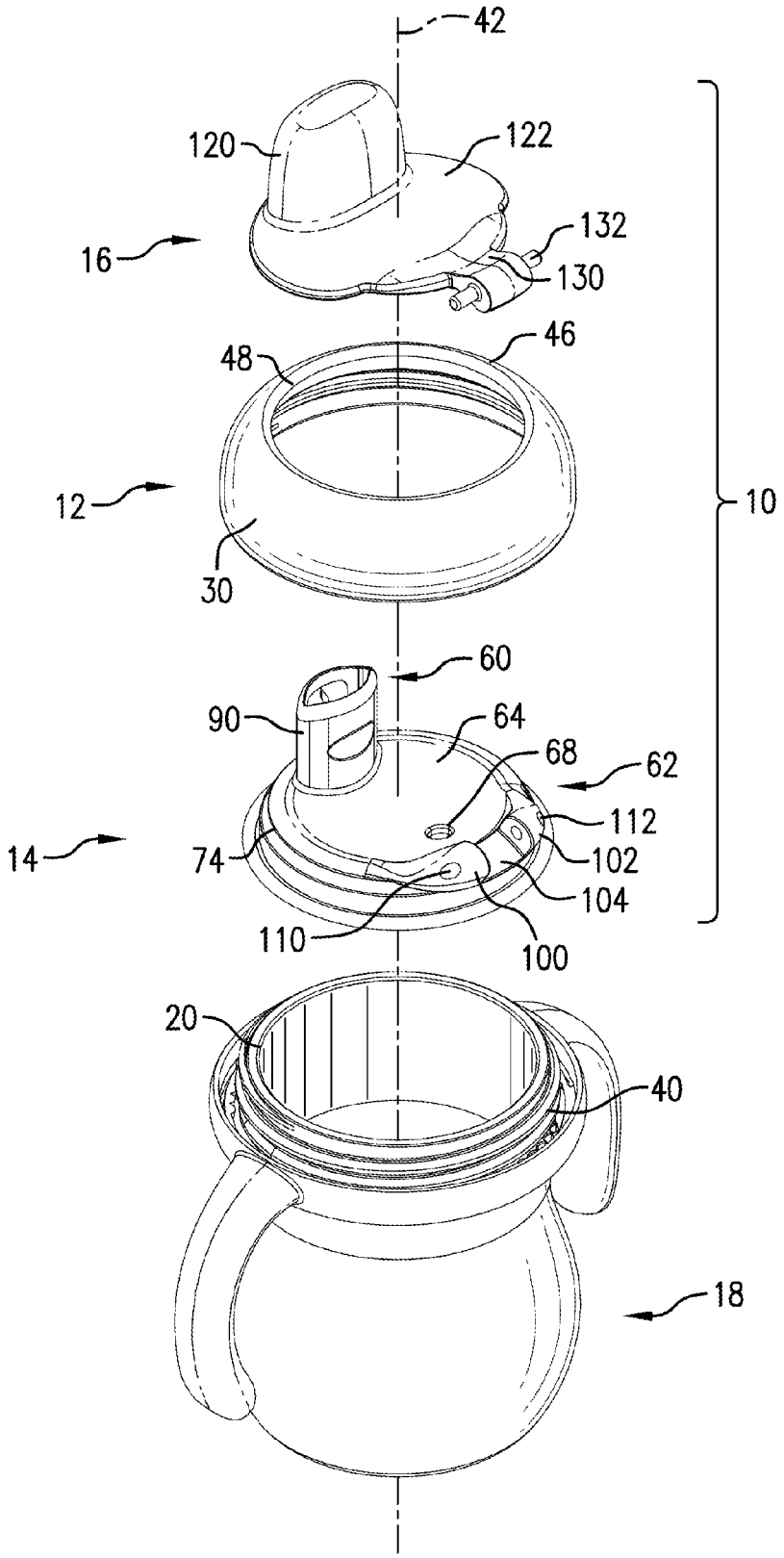
FIG. 1 is an exploded view of a drinking cup including a lid assembly.
Figure 2:
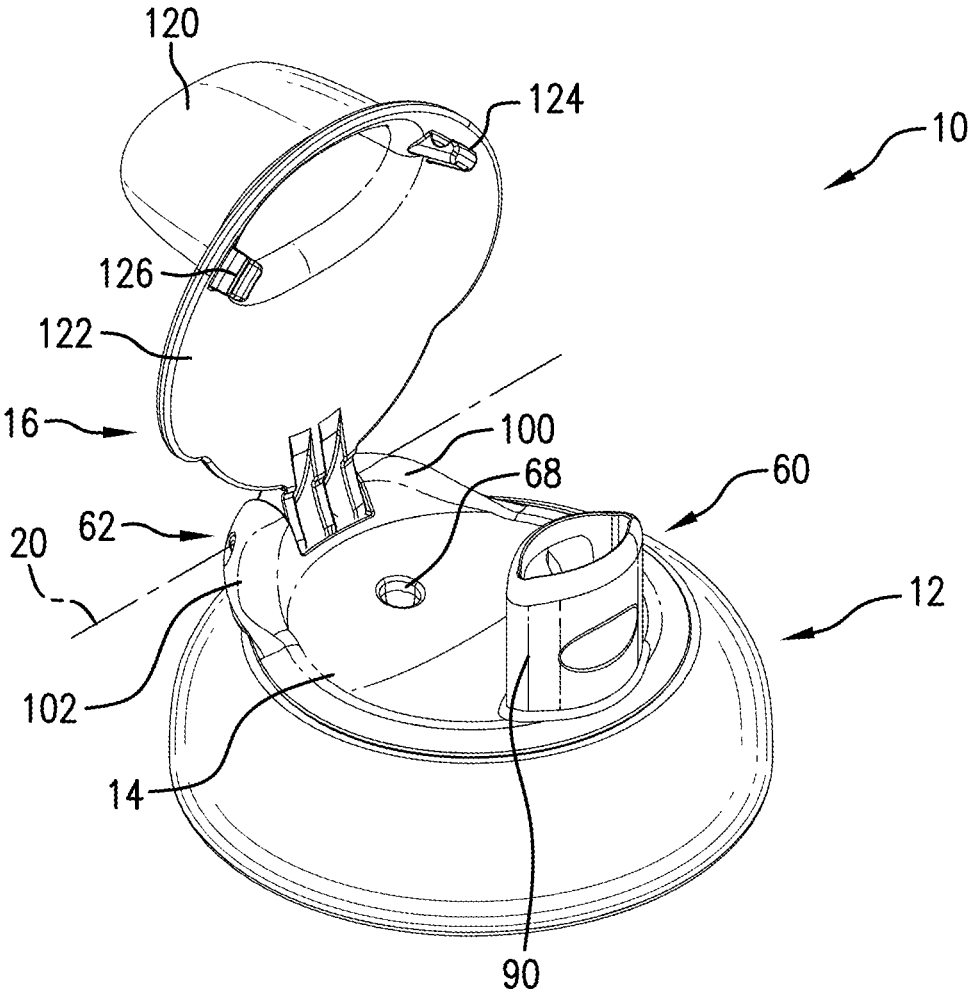
FIG. 2 is a perspective view of the lid assembly in an assembled state with a cap in an open position.

FIG. 1 depicts a lid assembly 10 including a retainer 12, a cover 14, and a cap 16. The lid assembly 10 connects with a drinking cup 18 to help prevent spills. The retainer 12 is configured to connect with the drinking cup 18. The cover 14 is configured to attach with the drinking cup 18 for covering an open top 20 of the drinking cup 18. In the illustrated embodiment, the retainer 12 retains the cover 14 to the drinking cup 18 when connected with the drinking cup 18. In an alternative arrangement, the cover 14 can attach with the drinking cup 18 without the need for the retainer 12. For example, the cover 14, which can be made from a soft, flexible material, can attach directly to the open top 20 of the drinking cup 18 by snapping over the drinking cup 18 at the open top 20. With reference to FIG. 2, the cap 16 connects with the cover 14 for pivotal movement with respect to the cover 14 about a pivot axis 22.

Figure 3:
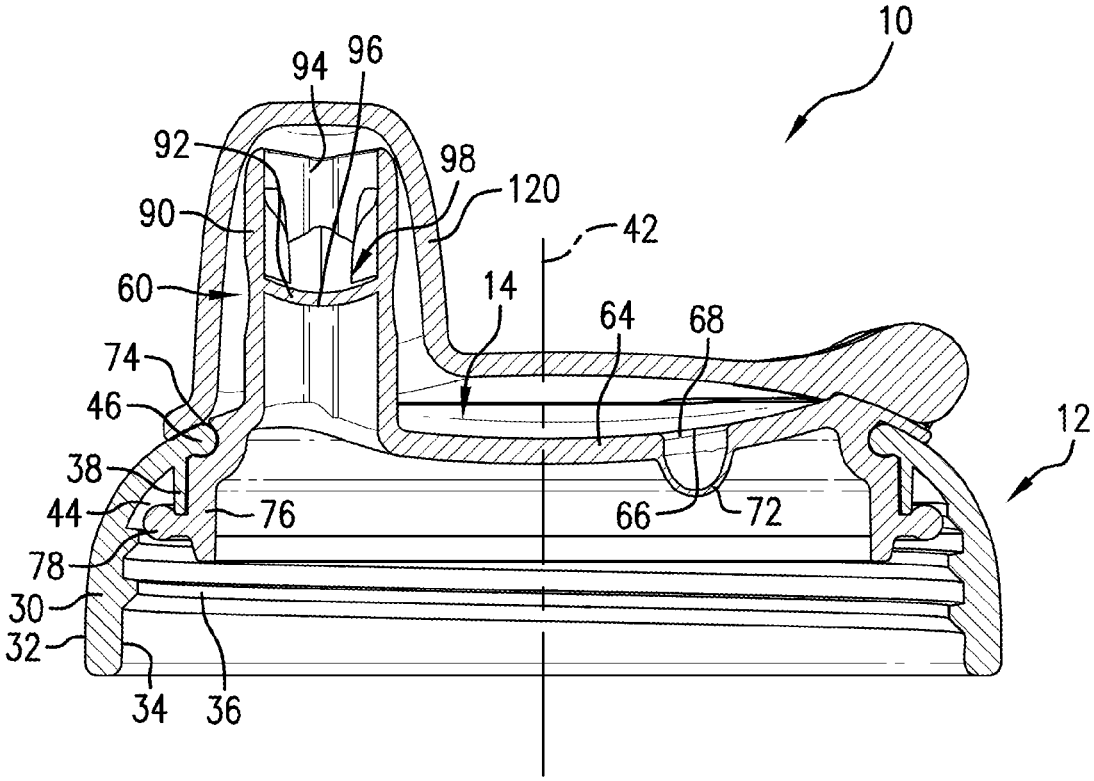
FIG. 3 is a cross-sectional view of the lid assembly shown in FIGS. 1 and 2.

The retainer 12 in the illustrated embodiment is formed of a rigid plastic material. With reference to FIG. 3, the retainer 12 includes an outer wall 30 having an outer surface 32 and an inner surface 34. The outer wall 30 is curved in a manner so that the outer surface 32 is convex. Internal threads 36 extend inwardly from the inner surface 34 and are configured to engage complementary threads 40 (FIG. 1) on the drinking cup 18 to attach the lid assembly 10 to the drinking cup 18. The lid assembly 10 can attach to the drinking cup 18 in other conventional manners such as a snap connection or a bayonet connection.

The retainer 12 is also provided with an inner wall 38 that extends downwardly from the inner surface 34 of the outer wall 30 parallel with a central axis 42 of the lid assembly 10 and the drinking cup 18. The inner wall 38 is circular in plan view (i.e., normal to the central axis 42). The inner wall 38 terminates above the outer wall 30 and defines a recess 44, which is circular in the illustrated embodiment, between the outer wall 30 and the inner wall 38.

The retainer 12 further includes a ledge 46 that extends radially inwardly from the inner wall 38. The ledge 46 defines an opening 48 (FIG. 1) in the retainer 12. The cover 14 contacts the ledge 46 when connected with the retainer 12 and covers the opening 48. The opening 48 in the illustrated embodiment is circular in plan view; however, the opening could be another shape.

The cover 14 is formed of a soft, flexible material such as silicone. The cover 14 is made from a relatively more flexible material that the material from which the retainer 12 and the cap 16 is formed. The cover 14 in the illustrated embodiment is formed entirely from the soft, flexible material; however, the cover 14 could be formed from dissimilar materials that are joined or bonded together.

With reference back to FIG. 1, the cover 14 includes an integrally molded spout 60 and an integrally molded cap mount 62. The cover 14 further includes a central section 64, which is concave in the illustrated embodiment. The central section 64 is generally circular in plan view. The cover 14 further includes a vent opening 66 spaced from the spout 60. In the illustrated embodiment, the vent opening 66 is provided in a recess 68 formed in the central section 64 and extending downwardly toward the drinking cup 18. The vent opening 66 in the illustrated embodiment is a slit provided through a membrane, hereinafter referred to as a vent membrane 72, at the bottom of the recess 68.

The cover 14 further includes a channel 74 provided around a periphery of the central section 64. In the illustrated embodiment, the channel 74 is circular; however, the channel 74 would take another configuration that would match the shape of the opening 48 where the shape of the opening 48 is not circular. The channel 74 receives the ledge 46 when the cover 14 is connected with the retainer 12. The cover 14 is connectable with the retainer 12 with the spout 60 located at a plurality of different locations around the retainer 12. In other words, the spout 60 can be located at a number of different angular positions and is not confined to one specific position with respect to the retainer 12.

The cover 14 further includes a peripheral wall 76 that extends downwardly from the central section 64 and is circular in the illustrated embodiment. The cover 14 further includes a gasket section 78 that extends radially outward from the peripheral wall 76. The gasket section 78 is also circular in the illustrated embodiment. The gasket section 78 is received in the recess 44 provided in the retainer 12 when the cover 14 is connected with the retainer 12. The gasket section 78 provides a seal between the lid assembly 10 and the drinking cup 18 when the lid assembly 10 is connected with the drinking cup 18. In an alternative arrangement, the cover 14 can be sandwiched between the drinking cup 18 and the retainer 12.

The spout 60 extends upwardly from the central section 64. The spout 60 is shaped and sized to be received in a child's mouth for drinking. The spout 60 includes a spout wall 90 extending upwardly from the central section 64. The spout wall 90 is generally cylindrical (elliptical in plan view) in configuration. In the illustrated embodiment, the spout wall 90 is elliptical in plan view. The spout 60 further includes a spout membrane 92 that extends inwardly from the spout wall 90 and is connected to the spout wall 90 to block a drink passage 94 provided in the spout 60 and defined by the spout wall 90. A drink slit 96 is provided in the spout membrane 92 to provide a drink valve 98 in the spout 60. The drink valve 98 remains closed until an adequate force of suction or a mechanical force is applied to the spout membrane 92 causing the drink valve 98 to open and allow fluid from the drinking cup 18 to flow through the drink passage 94. When the force or vacuum is released, the drink valve 98 returns to a closed position to prevent leakage.

In the illustrated embodiment, the spout 60 is diametrically opposed from the cap mount 62 with respect to the central axis 42. With reference back to FIG. 1, the cap mount 62 includes a thickened section (two thickened sections 100 and 102 are provided in the illustrated embodiment) extending upwardly from the central section 64. As illustrated, the cap mount 62 includes a first thickened section 100 and a second thickened section 102 spaced from the first thickened section 100 to define a recess 104. Each thickened section 100, 102 includes a respective opening 110, 112. Each thickened section 100, 102 also extends over and covers a portion of the retainer 12 when the cover 14 is connected with the retainer 12.

With the cap 16 connected with the cap mount 62, the cap 16 is moveable between an open position (an example of which is shown in FIG. 2) where the spout 60 is accessible to be received inside a person's mouth and a closed position (shown in FIGS. 3 and 4) where the cap 16 covers the spout 60. The cap 16 in the illustrated embodiment is made from a rigid plastic material. The cap 16 includes a spout hood 120 and a lower portion 122. The spout hood 120, which is a complementary shape to the spout 60, extends away from the lower portion 122 in a first direction and is configured to cover the spout 60 when the cap 16 is connected with the cap mount 62 and the cap 16 is in the closed position. The lower portion 122 is generally circular in plan view. The lower portion 122 of the cap 16 also covers the vent opening 66 (as well as the recess 68) when the cap 16 is connected with the cap mount 62 and the cap 16 is in the closed position. The lower portion 122 of the cap 16 also covers at least a majority (and nearly an entirety) of the central section 64 of the cover 14 when the cap 16 is connected with the cap mount 62 and the cap 16 is in the closed position.

Figure 4:
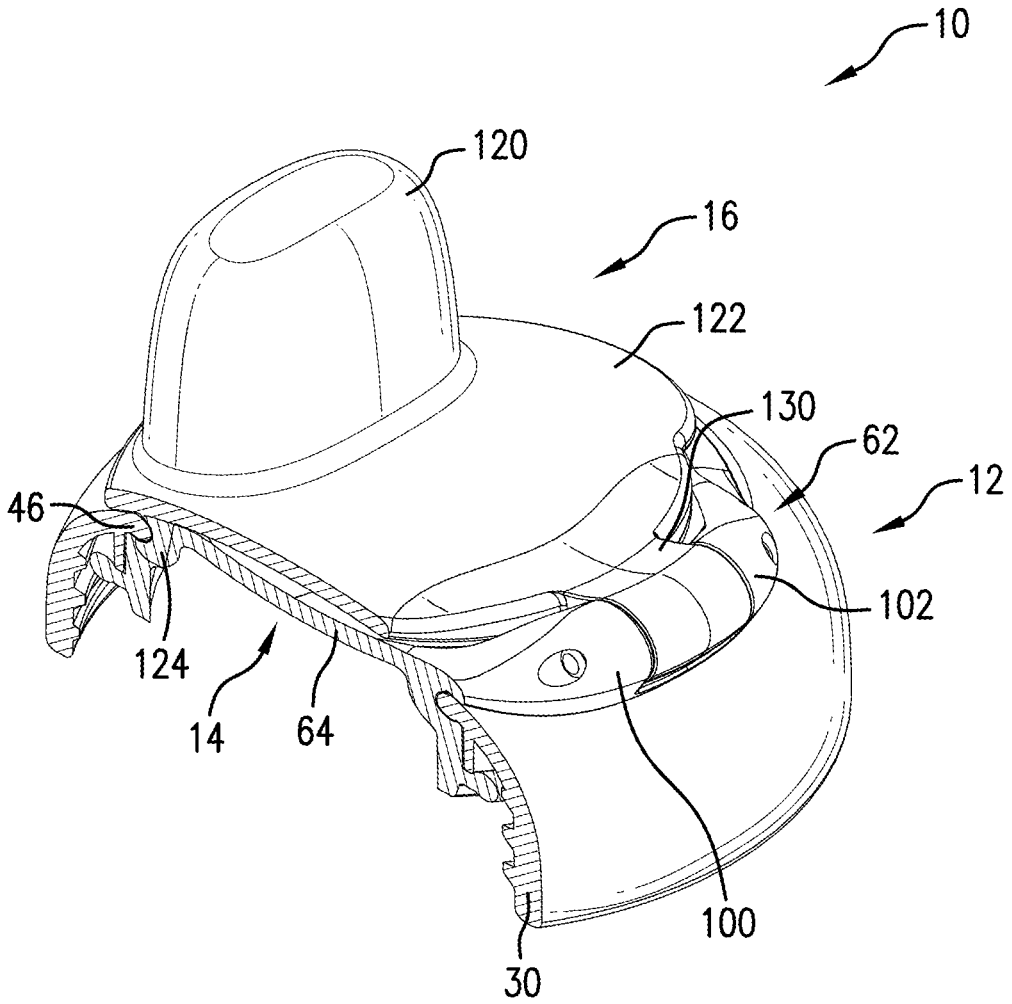
FIG. 4 is a perspective view partially in cross-section of the lid assembly shown in FIGS. 1-3.

The cap 16 also includes a barb (two barbs 124, 126 are shown in the illustrated embodiment). Each barb 124, 126 extends away from the lower portion 122 in a second direction, which is opposite the first direction (the direction in which the spout hood 120 extends away from the lower portion 122). Each barb 124, 126 is positioned adjacent the spout hood 120. Each barb 124, 126 engages the ledge 46 when the cap 16 is connected with the cap mount 62 and the cap 16 is in the closed position (see FIG. 4). With reference to FIG. 4, the barb 124 (and the barb 126) displaces a section of the cover 14 away from the ledge 46 when the cap 16 is connected with the cap mount 62 and the cap 16 is in the closed position. As mentioned above, each barb 124, 126 engages the retainer 12 when the cap 16 is connected with the cap mount 62, the cover 14 is connected with the retainer 12 and the cap 16 is in the closed position.

The cap 16 includes an arm 130 extending away from the lower portion 122 and diametrically opposed from the spout hood 120. The arm 130 is configured to cooperate with the cap mount 62 to facilitate connection between the cap 16 and the cap mount 62. The cap 16 also includes an axle (two axles 132, 134 are shown in the illustrated embodiment) extending away from the arm 130. The cap mount 62 is configured to receive each axle 132, 134 for connecting the cap 16 with the cap mount 62. A first axle 132 extends away from the arm 130 in a first direction and a second axle 134 extends away from the arm 130 in a second direction. The cap mount 62 includes the openings 110, 112, which are each configured to receive a respective axle 132, 134. In an alternative embodiment, notches could be provided in each thickened section 100, 102, and these notches could receive the axles 132, 134 to provide the pivotal connection between the cap 16 and the cap mount 62. The arm 130 is received in the recess 104 of the cap mount 62 when the cap 16 is connected with the cap mount 62. By providing the integrally molded cap mount 62 as part of the cover 14, the cap 16 is properly aligned to cover the spout 60 no matter how the cover 14 is angularly aligned with respect to the retainer 12.

A lid assembly for connecting with a drinking cup has been described above with particularity. Modifications and alterations will occur to those upon reading and understanding the preceding detailed description. The invention, however, is not limited to only the embodiment described above. Instead, the invention is broadly defined by the appended claims and the equivalents thereof. It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A lid assembly for connecting with a drinking cup, the lid assembly comprising:

a cover configured to attach with an associated drinking cup for at least partially covering an open top of the associated drinking cup, the cover being formed of a soft, flexible material and including an integrally molded spout and an integrally molded cap mount;

a cap configured to connect with the cap mount for pivotal movement with respect to the cover about a pivot axis, wherein with the cap connected to the cap mount, the cap is movable between an open position where the spout is accessible to be received inside a person's mouth and a closed position where the cap covers the spout, wherein the cap includes a barb; and a retainer configured to connect with the associated drinking cup, wherein the retainer retains the cover to the associated drinking cup when connected with the associated drinking cup, wherein the retainer includes a ledge defining an opening in the retainer, wherein the cover contacts the ledge when connected with the retainer and covers the opening, wherein the barb engages the ledge when the cap is connected with the cap mount and the cap is in the closed position.

2. The lid assembly of claim 1, wherein the cover includes a vent opening spaced from the spout, wherein the cap covers the vent opening when the cap is connected with the cap mount and the cap is in the closed position.

3. The lid assembly of claim 1, wherein the barb displaces a section of the cover away from the ledge when the cap is connected with the cap mount and the cap is in the closed position.

4. The lid assembly of claim 1, wherein the ledge and the opening are circular, wherein the cover includes a circular channel that receives the ledge when the cover is connected with the retainer.

5. The lid assembly of claim 1, wherein the cover is connectable with the retainer with the spout located at a plurality of different locations around the retainer.

6. The lid assembly of claim 1, wherein the cap includes a spout hood and a lower portion, wherein the spout hood extends away from the lower portion in a first direction and is configured to cover the spout when the cap is connected with the cap mount and the cap is in the closed position.

7. The lid assembly of claim 6, wherein the cover includes a vent opening spaced from the spout, wherein the lower portion of the cap covers the vent opening when the cap is connected with the cap mount and the cap is in the closed position.

8. The lid assembly of claim 6, wherein the cap includes an arm extending away from the lower portion and diametrically opposed from the spout hood, wherein the arm is configured to cooperate with the cap mount to facilitate connection between the cap and the cap mount.

9. The lid assembly of claim 8, wherein the cap includes an axle extending away from the arm and the cap mount is configured to receive the axle for connecting the cap with the cap mount.

10. The lid assembly of claim 9, wherein the cap mount includes an opening configured to receive the axle.

11. The lid assembly of claim 1, wherein the cap mount includes a thickened section and the cap includes an axle, wherein the thickened section is configured to receive the axle to connect the cap with the cover.

12. The lid assembly of claim 11, wherein the cap mount includes a first thickened section and a second thickened section spaced from the first thickened section to define a recess, wherein the cap includes an arm, a first axle extending away from the arm in a first direction and a second axle extending away from the arm in a second direction, wherein the arm is configured to be received in the recess and each thickened section is configured to receive a respective axle to connect the cap with the cover.

13. The lid assembly of claim 12, wherein each thickened section includes a respective opening configured to receive a respective axle to connect the cap with the cover.

14. The lid assembly of claim 1, wherein the cover is formed entirely from the soft, flexible material.

15. A lid assembly for connecting with a drinking cup, the lid assembly comprising:

a cover configured to attach with an associated drinking cup for at least partially covering an open top of the associated drinking cup, the cover being formed of a soft, flexible material and including an integrally molded spout and an integrally molded cap mount; and a cap configured to connect with the cap mount for pivotal movement with respect to the cover about a pivot axis, wherein with the cap connected to the cap mount, the cap is movable between an open position where the spout is accessible to be received inside a person's mouth and a closed position where the cap covers the spout, wherein the cap includes a spout hood and a lower portion, wherein the spout hood extends away from the lower portion in a first direction and is configured to cover the spout when the cap is connected with the cap mount and the cap is in the closed position, wherein the cap includes a barb extending away from the lower portion in a second direction, which is opposite the first direction, the barb being positioned adjacent the spout hood.

16. The lid assembly of claim 15, further comprising:

a retainer configured to connect with the associated drinking cup, wherein the retainer retains the cover to the associated drinking cup when connected with the associated drinking cup, wherein the retainer includes a ledge defining an opening in the retainer, wherein the cover includes a central section and a channel provided around a periphery of the central section, wherein the spout extends upwardly from the central section and the channel receives the ledge when the cover is connected with the retainer, wherein the lower portion of the cap covers at least a majority of the central section of the cover when the cap is connected with the cap mount and the cap is in the closed position.

17. The lid assembly of claim 16, wherein the lower portion and the central section are generally circular in plan view.

18. The lid assembly of claim 16, wherein the central section is concave.

19. A lid assembly for connecting with a drinking cup, the lid assembly comprising:

a cover configured to attach with an associated drinking cup for at least partially covering an open top of the associated drinking cup, the cover being formed of a soft, flexible material and including a central section, an integrally molded spout extending upwardly from the central section, an integrally molded cap mount extending upwardly from the central section, and a peripheral wall extending downwardly from the central section; and a cap configured to connect with the cap mount for pivotal movement with respect to the cover about a pivot axis, wherein with the cap connected to the cap mount, the cap is movable between an open position where the spout is accessible to be received inside a person's mouth and a closed position where the cap covers the spout, wherein the cap includes a spout hood and a lower portion, wherein the spout hood extends away from the lower portion in a first direction and is configured to cover the spout when the cap is connected with the cap mount and the cap is in the closed position, and the lower portion of the cap covers at least a majority of the central section of the cover when the cap is connected with the cap mount and the cap is in the closed position.

20. The lid assembly of claim 19, wherein the lower portion is generally circular in plan view.

21. The lid assembly of claim 19, further comprising:

a retainer configured to connect with the associated drinking cup, wherein the retainer retains the cover to the associated drinking cup when connected with the associated drinking cup, wherein the retainer includes a ledge defining an opening in the retainer, wherein the cover includes a channel provided around a periphery of the central section and the channel receives the ledge when the cover is connected with the retainer.

* * * * *